US010568401B2

(12) United States Patent
Fang

(10) Patent No.: US 10,568,401 B2
(45) Date of Patent: Feb. 25, 2020

(54) ADAPTABLE LUGGAGE CASE

(71) Applicant: Jianwen Fang, New York, NY (US)

(72) Inventor: Jianwen Fang, New York, NY (US)

( * ) Notice: Subject to any disclaimer, the term of this patent is extended or adjusted under 35 U.S.C. 154(b) by 31 days.

(21) Appl. No.: 15/804,277

(22) Filed: Nov. 6, 2017

(65) Prior Publication Data

US 2018/0125188 A1 May 10, 2018

Related U.S. Application Data

(60) Provisional application No. 62/418,714, filed on Nov. 7, 2016.

(51) Int. Cl.
*A45C 7/00* (2006.01)

(52) U.S. Cl.
CPC ..... *A45C 7/0045* (2013.01)

(58) Field of Classification Search
CPC ..... A45C 7/0045
See application file for complete search history.

(56) References Cited

U.S. PATENT DOCUMENTS 2,057,942 A * 10/1936 Fay ..... A63H 33/108 446/112
2,960,246 A * 11/1960 Lovelace ..... B60P 3/1033 414/534
4,081,061 A 3/1978 Tucker
4,424,841 A * 1/1984 Smith ..... A45C 7/0086 190/102
4,693,345 A * 9/1987 Mittelmann ..... A45C 5/00 190/108
5,082,094 A * 1/1992 Nechushtan ..... A45C 7/005 190/105
5,358,082 A 10/1994 Armstrong
5,415,255 A 5/1995 Hafner
5,472,082 A * 12/1995 Thiele ..... A45C 7/0031 190/105
5,547,052 A 8/1996 Latshaw
5,628,443 A * 5/1997 Deutsch ..... A45C 7/0086 150/113
5,890,613 A * 4/1999 Williams ..... A45C 7/0045 220/23.4
6,050,373 A * 4/2000 Wonka ..... A45C 5/03 190/103
6,213,266 B1 4/2001 Hollingsworth
6,408,997 B1 6/2002 Chen
6,557,955 B2 * 5/2003 Saravis ..... A47B 47/0033 312/111
7,240,778 B2 7/2007 Duncanson et al.
8,365,886 B2 2/2013 Mehta
(Continued)

*Primary Examiner* — Tri M Mai
(74) *Attorney, Agent, or Firm* — Olav M. Underdal; IDP Patent Services

(57) ABSTRACT

An adaptable luggage case includes a complete plurality of detachably connected components, including a first reduction group of components and a first reduced plurality of components that includes a second reduction group of components and second reduced plurality of components; such that the first reduced plurality of components assembles into a first reduced size luggage case, which is smaller than the adaptable luggage case; such that the second reduced plurality of components assembles into a second reduced size luggage case, which is smaller than the first reduced size luggage case.

15 Claims, 17 Drawing Sheets

(56) References Cited

U.S. PATENT DOCUMENTS

| | | | | |
|---|---|---|---|---|
| 8,584,327 | B1 * | 11/2013 | Kodak | A61G 17/0076 220/4.28 |
| 9,101,186 | B2 | 8/2015 | Lai | |
| 9,119,453 | B1 | 9/2015 | LaRocque | |
| 2004/0124191 | A1 * | 7/2004 | Colladon | B65D 11/1873 220/4.01 |
| 2005/0077136 | A1 | 4/2005 | Brannin | |
| 2006/0037824 | A1 | 2/2006 | Park et al. | |
| 2009/0139814 | A1 | 6/2009 | Grossman et al. | |
| 2013/0140120 | A1 * | 6/2013 | Rasmussen | A45C 7/005 190/109 |
| 2015/0144447 | A1 | 5/2015 | Mandel | |
| 2017/0079397 | A1 | 3/2017 | Loomis | |
| 2017/0245608 | A1 | 8/2017 | King | |
| 2017/0355485 | A1 * | 12/2017 | Finke | B65D 19/18 |

* cited by examiner

Adaptable Luggage Case

ADAPTABLE LUGGAGE CASE

CROSS-REFERENCE TO RELATED APPLICATIONS

This U.S. Non-Provisional Application claims the benefit of U.S. Provisional Application No. 62/418,714, filed Nov. 7, 2016.

FIELD OF THE INVENTION

The present invention relates generally to the field of luggage, and more particularly to methods and systems for luggage cases, including trolley cases, which can be adapted to change the size of the luggage case.

BACKGROUND OF THE INVENTION

Luggage cases have been used for centuries as a means for transporting clothing and other personal items during travel. Trolley cases, a form of suitcase on wheels, have become particularly popular in recent years for use in air travel, both for use as carry-on roller cases, and for checked luggage.

However, luggage cases are inflexible in terms of their size, and consumers are thus forced to procure several luggage cases of different sizes. A frequent traveler may for example chose to own several sizes of carry-on trolley cases, and several sizes of suit cases for travels of different length and with differing needs for the number of personal items brought on the trip. For a day business trip, the frequent traveler may for example only need a small carry-on, whereas for a 3-day business trip, the frequent traveler may desire to bring a maximum size carry-on trolley case.

As such, considering the foregoing, it may be appreciated that there continues to be a need for novel and improved devices and methods for adaptable size luggage cases.

SUMMARY OF THE INVENTION

The foregoing needs are met, to at least a great extent, by the present invention, wherein in aspects of this invention, enhancements are provided to the existing model of luggage cases.

In an aspect, an adaptable luggage case, can include:

a) a first case side, including:
- a first lateral section structure, including a first plurality of detachably connected components;
- a second lateral section structure, including a second plurality of detachably connected components, such that the second lateral section structure can be detachably connected to the first lateral section structure; and
- a third lateral section structure, including a third plurality of detachably connected components, such that the third lateral section structure can be detachably connected to the second lateral section structure; and b) a second case side, including:
- A fourth lateral section structure, including a fourth plurality of detachably connected components; and
- A fifth lateral section structure, including a fifth plurality of detachably connected components, such that the fifth lateral section structure can be detachably connected to the fourth lateral section structure;
- wherein the first lateral section structure can form a front of the adaptable luggage case;
- wherein the fifth lateral section structure forms a rear of the adaptable luggage case;

such that the first, second, third, fourth, and fifth pluralities of detachably connected components comprise a complete plurality of components;

wherein the adaptable luggage case can be configured to be disassembled into the complete plurality of components, which comprises a reduced plurality of components;

such that the reduced plurality of components is configured to be assembled into a reduced size luggage case, which is smaller than the adaptable luggage case.

In another aspect, an adaptable luggage case can include a complete plurality of components that are detachably connected; such that the adaptable luggage case can be configured to be disassembled into the complete plurality of components, which comprises a first reduction group of components and a first reduced plurality of components; such that the first reduced plurality of components is configured to be assembled into a first reduced size luggage case, which is smaller than the adaptable luggage case.

In a related aspect, the first reduced plurality of components can include a second reduction group of components and a second reduced plurality of components; such that the second reduced plurality of components can be configured to be assembled into a second reduced size luggage case, which is smaller than the first reduced size luggage case.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
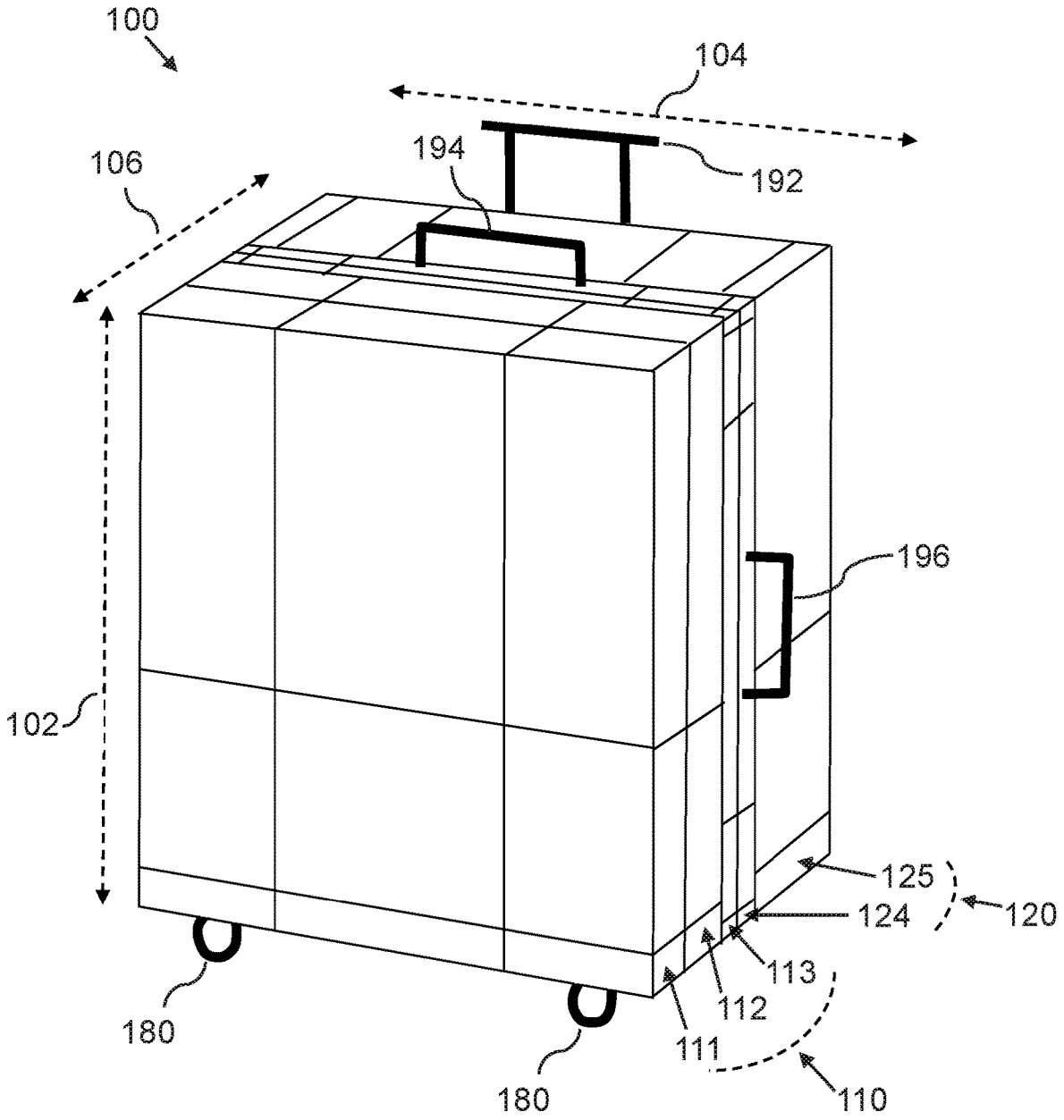
FIG. 1 is a front perspective view of an adaptable luggage case at maximum capacity, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an adaptable luggage case 100 with reference to FIG. 1, in such manner that like reference numerals refer to like components throughout; a convention that we shall employ for the remainder of this specification.

In an embodiment, as shown in FIG. 1, an adaptable luggage case 100 can include:

a) A first case side 110, which can also be referred to as a system V1 110, the first case side 110 including:
   i. A first lateral section structure 111, comprising a first plurality of detachably connected components;
   ii. A second lateral section structure 112, comprising a second plurality of detachably connected components, such that the second lateral section structure 112 can be detachably connected to the first lateral section structure 111; and
   iii. A third lateral section structure 113, comprising a third plurality of detachably connected components, such that the third lateral section structure 113 can be detachably connected to the second lateral section structure 112; and b) A second case side 120, which can also be referred to as a system V2 120, the second case side 120 including:
   iv. A fourth lateral section structure 124, comprising a fourth plurality of detachably connected components; and
   v. A fifth lateral section structure 125, comprising a fifth plurality of detachably connected components, such that the fifth lateral section structure 113 can be detachably connected to the fourth lateral section structure 124;

wherein the first lateral section structure 111 forms a front of the adaptable luggage case 100;

wherein a front peripheral/circumferential/perimetral edge of the second lateral section structure 112 can be detachably connected to a rear peripheral/circumferential/perimetral edge of the first lateral section structure 111;

wherein a front peripheral/circumferential/perimetral edge of the third lateral section structure 113 can be detachably connected to a rear peripheral/circumferential/perimetral edge of the second lateral section structure 112;

wherein a front peripheral/circumferential/perimetral edge of the fourth lateral section structure 124 can be detachably connected to a rear peripheral/circumferential/perimetral edge of the third lateral section structure 113;

wherein a front peripheral/circumferential/perimetral edge of the fifth lateral section structure 125 can be detachably connected to a rear peripheral/circumferential/perimetral edge of the fourth lateral section structure 124;

wherein the fifth lateral section structure 125 forms a rear of the adaptable luggage case 100;

such that the first, second, third, fourth, and fifth pluralities of detachably connected components comprise a complete plurality of components; wherein the adaptable luggage case 100 is configured to be disassembled into the complete plurality of components, which comprises a reduction group of components and a reduced plurality of components;

such that the reduced plurality of components is configured to be assembled into a reduced size luggage case 200, which is smaller than the adaptable luggage case 100.

In a related embodiment, an adaptable luggage case 100, can include:

a) a first case side 110, including:
   at least one lateral section structure 111 112 113, comprising a first case side plurality of detachably connected components (which can also be called a primary plurality of detachably connected components); and b) a second case side 120, comprising:
   at least one lateral section structure 124 125, comprising a second case side plurality of detachably connected components (which can also be called a secondary plurality of detachably connected components);

wherein in the first and second case sides 110 120 can be pivotably connected; wherein the adaptable luggage case 100 is configured to be disassembled into a complete plurality of components, which comprises a reduction group of components and a reduced plurality of components;

such that the reduced plurality of components is configured to be assembled into a reduced size luggage case 200, which is smaller than the adaptable luggage case 100.

Figure 2:
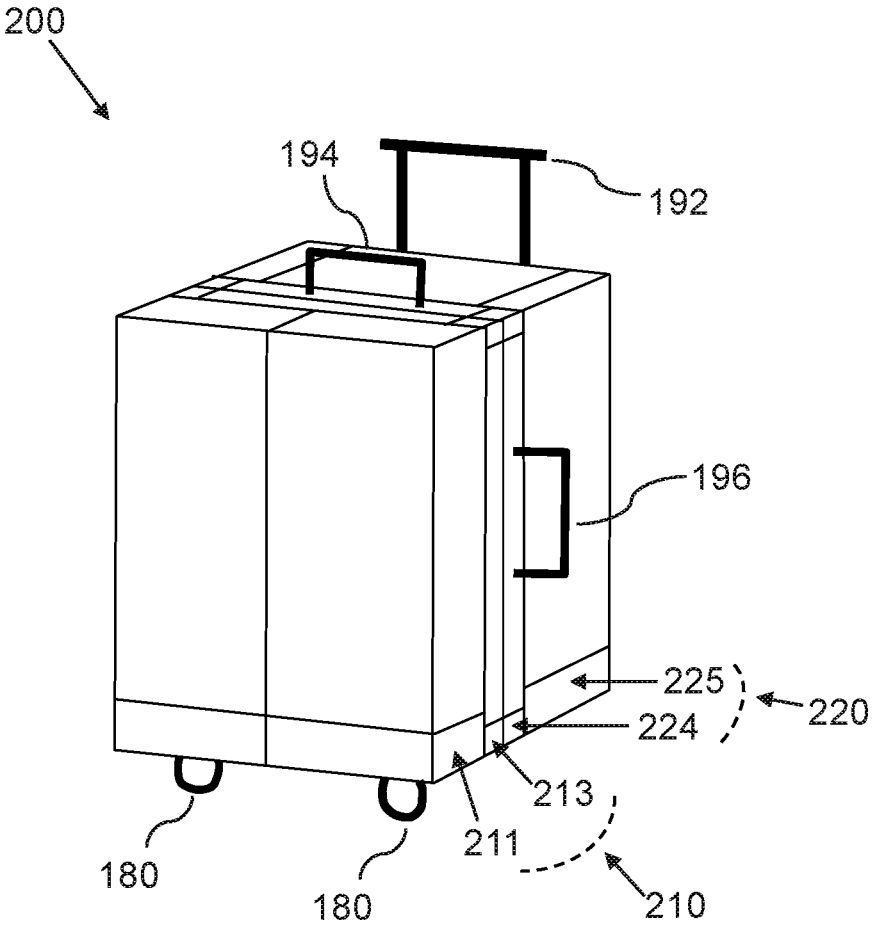
FIG. 2 is a front perspective view of an adaptable luggage case at minimum capacity, according to an embodiment of the invention.

In another embodiment, as shown in FIG. 2, an adaptable luggage case 200 can include:

a) A modified first case side 210, including:
   i. A modified first lateral section structure 211;
   ii. A modified third lateral section structure 213, which can be detachably connected to the second lateral section structure 112; and b) A modified second case side 220, including:
   i. A modified fourth lateral section structure 224; and
   ii. A modified fifth lateral section structure 225, which can be detachably connected to the fourth lateral section structure 124;

wherein the modified first lateral section structure 211 forms a front of the adaptable luggage case 200;

wherein a front peripheral/circumferential/perimetral edge of the modified third lateral section structure 213 can be detachably connected to a rear peripheral/circumferential/perimetral edge of the modified second lateral section structure 212;

wherein a front peripheral/circumferential/perimetral edge of the modified fourth lateral section structure 224 can be detachably connected to a rear peripheral/circumferential/perimetral edge of the modified third lateral section structure 213;

wherein a front peripheral/circumferential/perimetral edge of the modified fifth lateral section structure 225 can be detachably connected to a rear peripheral/circumferential/perimetral edge of the modified fourth lateral section structure 224;

wherein the modified fifth lateral section structure 225 forms a rear of the adaptable luggage case 200;

whereby the smaller adaptable luggage case 200 is formed by removing components from the larger adaptable luggage case 100.

In related embodiments, as shown in FIGS. 1, 2, 7, 12, 13, 14, and 16, the adaptable luggage case 100 200 can be configured with at least two wheels 180, or with four wheels 180, on a bottom of the adaptable luggage case 100 200, such that the adaptable luggage case 100 200 can be configured as an adaptable trolley case 100 200. Alternatively, the adaptable luggage case 100 200 can be configured without wheels 180, such that the adaptable luggage case 100 200 can be configured as an adaptable trolley case 100 200.

Figure 3:
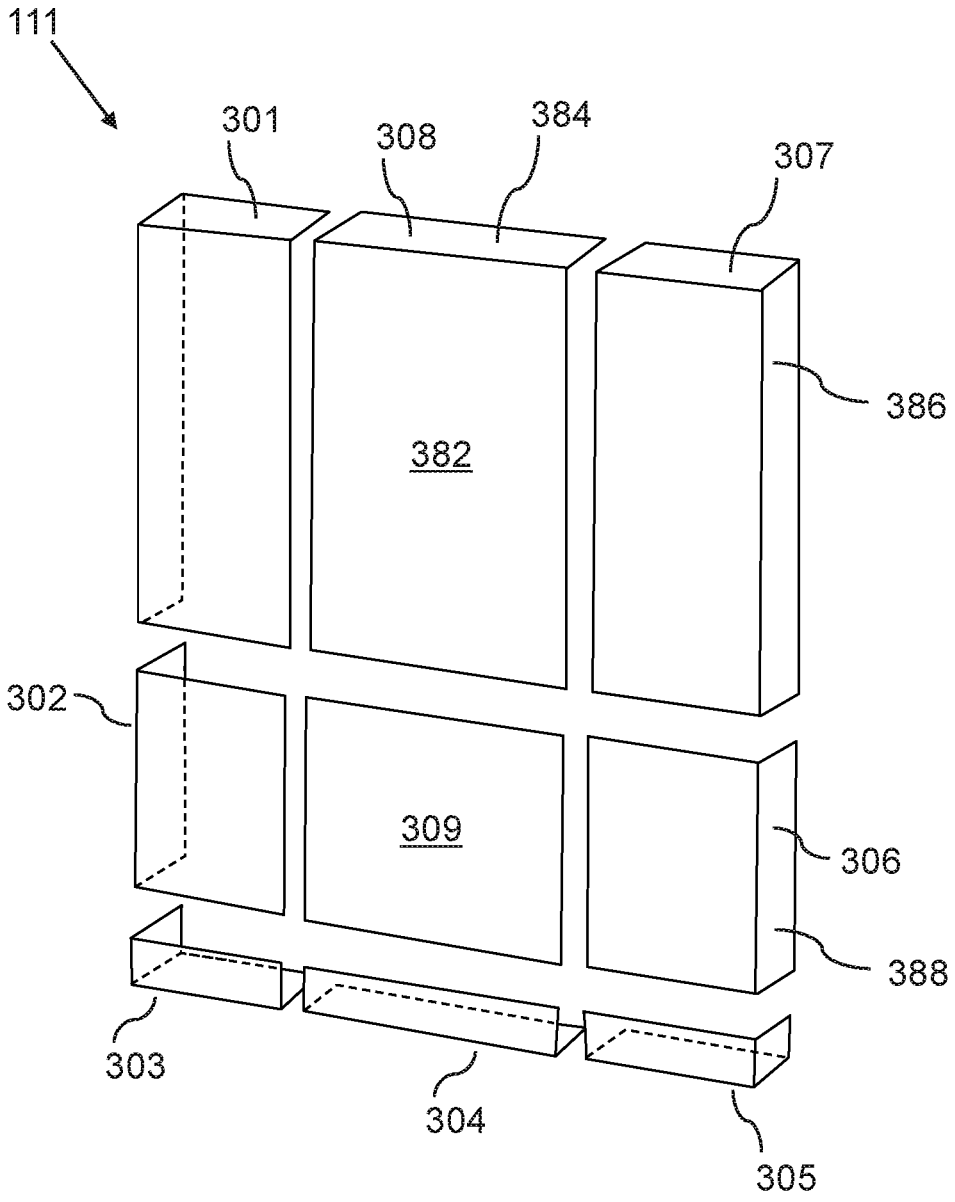
FIG. 3 is a front perspective view of a first lateral section structure of the adaptable luggage case shown in FIG. 1, according to an embodiment of the invention.

In a related embodiment, as shown in FIG. 3, the first lateral section structure 111, which can also be called the front structure 111, can include a first plurality of components that are configured to be detachably connected to form a pan-shaped structure that functions as a front of the adaptable luggage case 100. Each component can have a front facing substantially flat part 382 and a side facing flange part 384, which can be a corner flange 386 or a side flange 388. The front facing substantially flat part 382 and the side facing flange part 384 can be substantially perpendicularly connected. A middle center component 309 can be flat or substantially flat. In alternative embodiments, the first lateral section structure 111 can be substantially flat, such that the components do not have flanges 384 386 388.

In a related embodiment, the adaptable luggage case 100 can include a complete plurality of components that are detachably connected;

wherein the adaptable luggage case 100 is configured to be disassembled into the complete plurality of components, which comprises a first reduction group of components and a first reduced plurality of components;

such that the first reduced plurality of components is configured to be assembled into a first reduced size luggage case 200, which is smaller than the adaptable luggage case 100.

In a further related embodiment, the first reduced plurality of components can include a second reduction group of components and a second reduced plurality of components; such that the second reduced plurality of components is configured to be assembled into a second reduced size luggage case 200, which is smaller than the first reduced size luggage case 100.

In a related embodiment, an adaptable luggage case system 100 can include a complete plurality of components, which are configured to be detachably connected into an adaptable luggage case 100;

wherein the complete plurality of components comprises a first reduction group of components and a first reduced plurality of components;

such that the first reduced plurality of components is configured to be assembled into a first reduced size luggage case 200, which is smaller than the adaptable luggage case 100.

In a related embodiment, as shown in FIG. 3, the first lateral section structure 111, can include:

a) A left top corner component 301, which is configured to detachably connect to the top center component 308 and the left center component 302;

b) A top center component 308, which is configured to detachably connect to the left top corner component 301, the right top corner component 307, and the middle center component 309;

c) A right top corner component 307, which is configured to detachably connect to the top center component 308 and the right center component 306;

d) A left center component 302, which is configured to detachably connect to the left top corner component 301, the middle center component 309, and the left bottom corner component 303;

e) A middle center component 309, which is configured to detachably connect to the top center component 308, the right center component 306, bottom center component 304, and the left center component 302;

f) A right center component 306, which is configured to detachably connect to the right top corner component 307, the middle center component 309, and the right bottom corner component 305;

g) A left bottom corner component 303, which is configured to detachably connect to the left center component 302, and the bottom center component 304;

h) A bottom center component 304, which is configured to detachably connect to the left bottom corner component 303, the middle center component 309, and the right bottom corner component 305; and i) A right bottom corner component 305, which is configured to detachably connect to the right center component 306 and the bottom center component 304.

Figure 4:
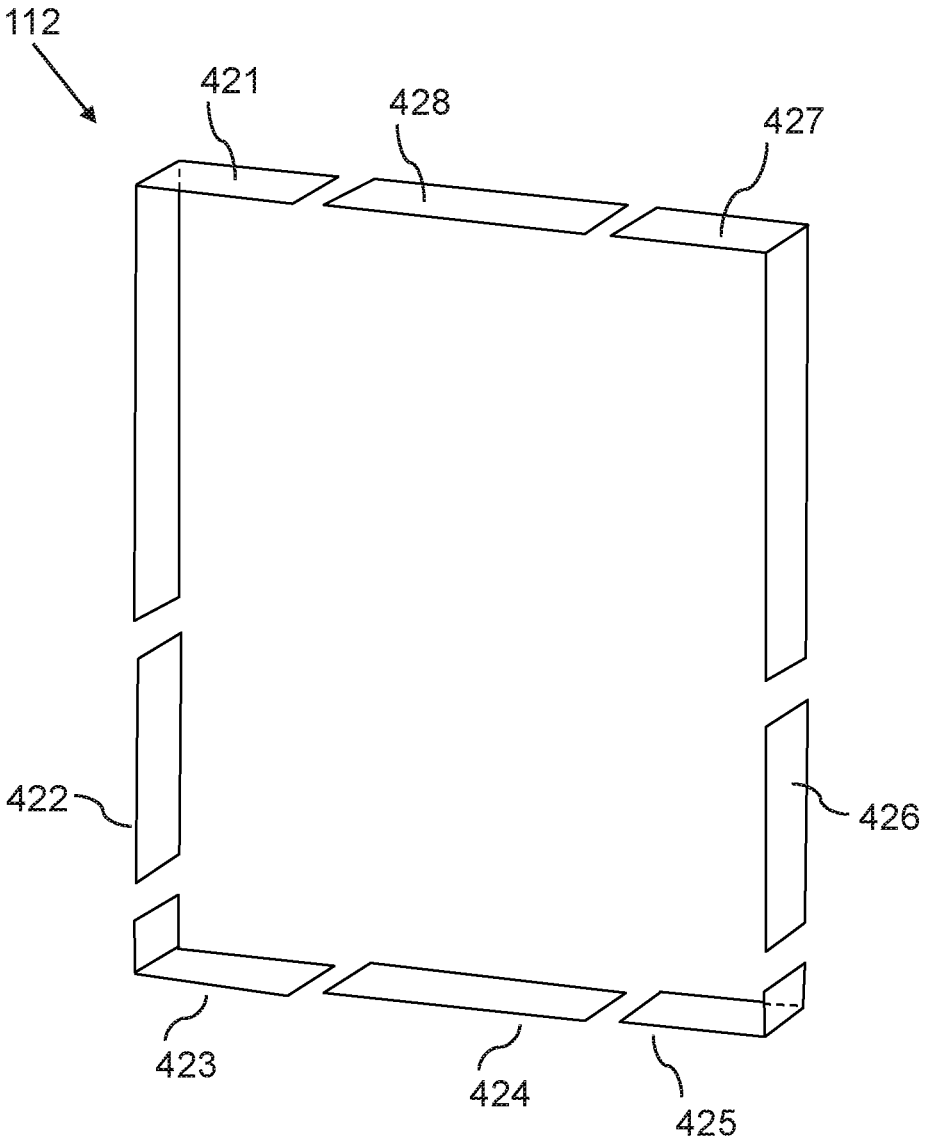
FIG. 4 is a front perspective view of a second lateral section structure of the adaptable luggage case shown in FIG. 1, according to an embodiment of the invention.

In a related embodiment, as shown in FIG. 4, the second lateral section structure 112, can include a second plurality of components that are configured to be detachably connected to form a connected, substantially rectangular edge band that functions as a peripheral/circumferential/perimetral siding part 112 of the adaptable luggage case 100.

In a related embodiment, as shown in FIG. 4, the second lateral section structure 112, can include:

a) A left top corner component 421, which can be I-shaped, and which is configured to detachably connect between the left center component 422 and the top center component 428;

b) A top center component 428, which is configured to detachably connect between the left top corner component 421 and the right top corner component 427;

c) A right top corner component 427, which is configured to detachably connect between the top center component 428 and the right center component 426;

d) A right center component 426, which is configured to detachably connect between the right top corner component 427 and the right bottom corner component 425;

e) A right bottom corner component 425, which is configured to detachably connect between the right center component 426 and the bottom center component 424;

f) A bottom center component 424, which is configured to detachably connect between the left bottom corner component 423 and the left center component 422; and g) A left bottom corner component 423, which is configured to detachably connect between the bottom center component 424 and the left center component 422;

h) A left center component 422, which is configured to detachably connect between the left bottom corner component 423 and the left top corner component 421.

Figure 5:
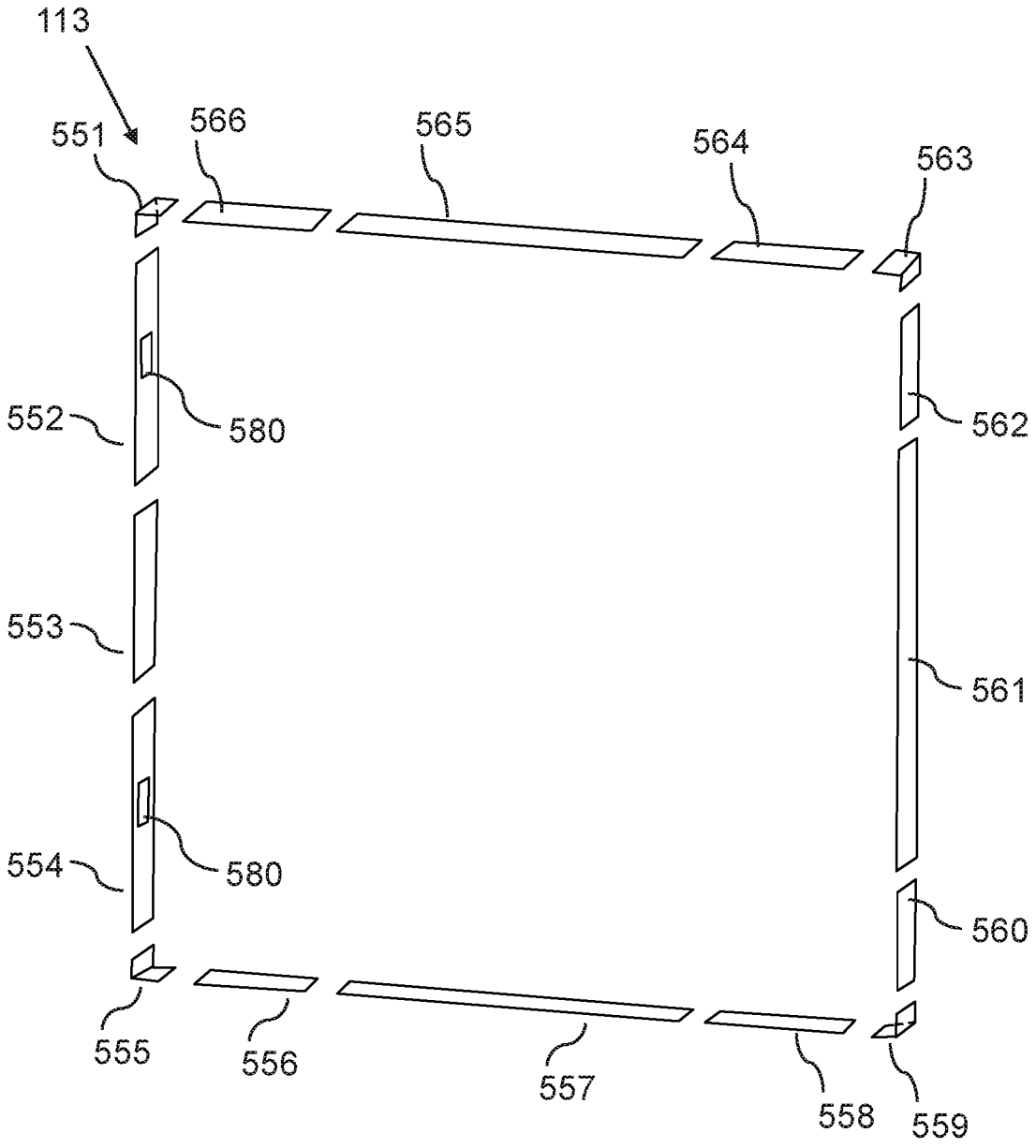
FIG. 5 is a front perspective view of a third lateral section structure of the adaptable luggage case shown in FIG. 1, according to an embodiment of the invention.

In a related embodiment, as shown in FIG. 5, the third lateral section structure 113, can include a third plurality of components that are configured to be detachably connected to form a rectangular edge band that functions as a peripheral/circumferential/perimetral siding part 113 of the adaptable luggage case 100.

In a related embodiment, as shown in FIG. 5, the third lateral section structure 113, can include:

a) A left top corner component 551, which can be I-shaped, and which is configured to detachably connect between the left top side component 552 and the top left center component 566;

b) A top left center component 566, which is configured to detachably connect between the left top corner component 551 and the top middle center component 565;

c) A top middle center component 565, which is configured to detachably connect between the top left center component 566 and the top right center component 564;

d) A top right center component 564, which is configured to detachably connect between the top middle center component 565 and the right top corner component 563;

e) A right top corner component 563, which is configured to detachably connect between the top right center component 564 and the right top side component 562;

f) A right top side component 562, which is configured to detachably connect between the right top corner component 563 and the right center side component 561;

g) A right center side component 561, which is configured to detachably connect between the right top side component 562 and the right bottom side component 560; and h) A right bottom side component 560, which is configured to detachably connect between the right center side component 561 and the right bottom corner component 559;

i) A right bottom corner component 559, which is configured to detachably connect between the right bottom side component 560 and the bottom right center component 558.

j) A bottom right center component 558, which is configured to detachably connect between the right bottom corner component 559 and the bottom middle center component 557;

k) A bottom middle center component 557, which is configured to detachably connect between the bottom right center component 558 and the bottom left center component 556;

l) A bottom left center component 556, which can be I-shaped, and which is configured to detachably connect between the bottom middle center component 557 and the left bottom corner component 555;

m) A left bottom corner component 555, which is configured to detachably connect between the bottom left center component 556 and the left bottom side component 554.

n) A left bottom side component 554, which is configured to detachably connect between the left bottom corner component 555 and the left center side component 553;

o) A left center side component 553, which is configured to detachably connect between the left bottom side component 554 and the left top side component 552; and p) A left top side component 552, which is configured to detachably connect between the left center side component 553 and the left top corner component 551.

Figure 6:
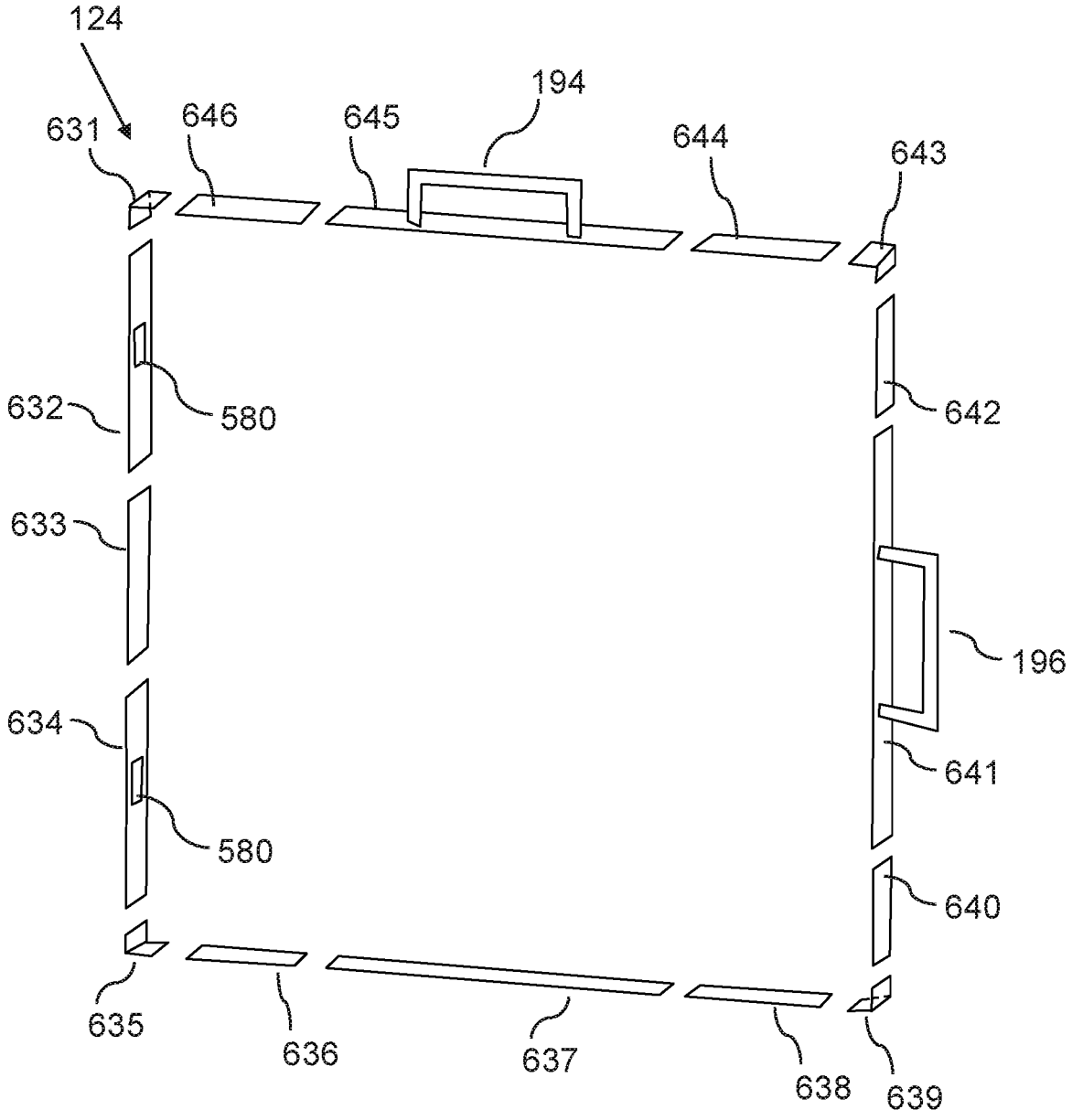
FIG. 6 is a front perspective view of a fourth lateral section structure of the adaptable luggage case shown in FIG. 1, according to an embodiment of the invention.

In a related embodiment, as shown in FIG. 6, the fourth lateral section structure 124, can include a fourth plurality of components that are configured to be detachably connected to form a rectangular edge band that functions as a peripheral/circumferential/perimetral siding part 124 of the adaptable luggage case 100.

In a related embodiment, as shown in FIG. 6, the fourth lateral section structure 124, can include:

a) A left top corner component 631, which can be I-shaped, and which is configured to detachably connect between the left top side component 632 and the top left center component 646;

b) A top left center component 646, which is configured to detachably connect between the left top corner component 631 and the top middle center component 645;

c) A top middle center component 645, which is configured to detachably connect between the top left center component 646 and the top right center component 644;

d) A top right center component 644, which is configured to detachably connect between the top middle center component 645 and the right top corner component 643;

e) A right top corner component 643, which is configured to detachably connect between the top right center component 644 and the right top side component 642;

f) A right top side component 642, which is configured to detachably connect between the right top corner component 643 and the right center side component 641;

g) A right center side component 641, which is configured to detachably connect between the right top side component 642 and the right bottom side component 640; and h) A right bottom side component 640, which is configured to detachably connect between the right center side component 641 and the right bottom corner component 639;

i) A right bottom corner component 639, which is configured to detachably connect between the right bottom side component 640 and the bottom right center component 638.

j) A bottom right center component 638, which is configured to detachably connect between the right bottom corner component 639 and the bottom middle center component 637;

k) A bottom middle center component 637, which is configured to detachably connect between the bottom right center component 638 and the bottom left center component 636;

l) A bottom left center component 636, which can be I-shaped, and which is configured to detachably connect between the bottom middle center component 637 and the left bottom corner component 635;

m) A left bottom corner component 635, which is configured to detachably connect between the bottom left center component 636 and the left bottom side component 634.

n) A left bottom side component 634, which is configured to detachably connect between the left bottom corner component 635 and the left center side component 633;

o) A left center side component 633, which is configured to detachably connect between the left bottom side component 634 and the left top side component 632; and p) A left top side component 632, which is configured to detachably connect between the left center side component 633 and the left top corner component 631.

Figure 7:
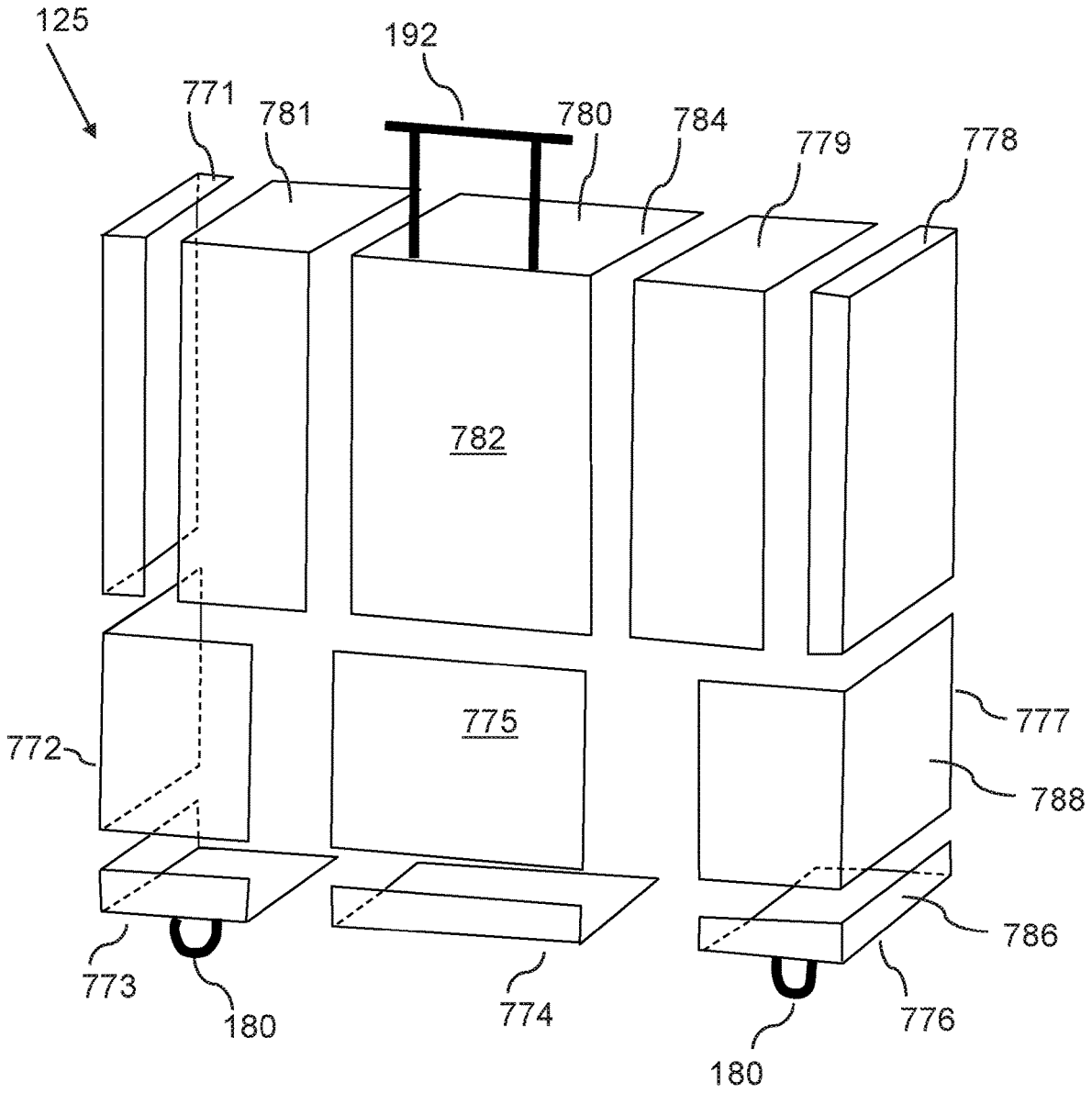
FIG. 7 is a rear perspective view of a fifth lateral section structure of the adaptable luggage case shown in FIG. 1, according to an embodiment of the invention.

In a related embodiment, as shown in FIG. 7, the fifth lateral section structure 125, which can also be called the rear structure 125, can include a fifth plurality of components that are configured to be detachably connected to form a pan-shaped system that functions as a rear of the adaptable luggage case 100. Each component can have a rear facing substantially flat part 782 and a side facing flange part 784, which can be a corner flange 786 or a side flange 788. A middle center component 775 can be flat or substantially flat. In alternative embodiments, the rear structure 125 can be substantially flat, such that the components do not have flanges.

In a related embodiment, as shown from rear in FIG. 7 (such that right and left sides appear left and right in drawing), the fifth lateral section structure 125, can include:

a) A right top corner component 771, which is configured to detachably connect to the top right center component 781 and the right center component 772;

b) A top right center component 781, which is configured to detachably connect to the top middle center component 780, the right center component 772, and the right top corner component 771;

c) A top middle center component 780, which is configured to detachably connect to the top left center component 779, the middle center component 775, and the top right center component 781;

d) A top left center component 779, which is configured to detachably connect to the top middle center component 780, the left top corner component 778, and the left center component 777;

e) A left top corner component 778, which is configured to detachably connect to the top left center component 779 and the left center component 777;

f) A right center component 772, which is configured to detachably connect to the right top corner component 771, the top right center component 781, the middle center component 775, and the right bottom corner component 773;

g) A middle center component 775, which is configured to detachably connect to the top middle center component 780, the left center component 777, bottom center component 774, and the right bottom corner component 773;

h) A left center component 777, which is configured to detachably connect to the top left center component 779, the left top corner component 778, the left bottom corner component 776, and the middle center component 775;

i) A right bottom corner component 773, which is configured to detachably connect to the bottom center component 774, and the right center component 772;

j) A bottom center component 774, which is configured to detachably connect to the middle center component 775, the left bottom corner component 776, and the right bottom corner component 773; and k) A left bottom corner component 776, which is configured to detachably connect to the left center component 777 and the bottom center component 774.

In a further related embodiment, as shown in FIGS. 1, 2, 7, and 12, the adaptable luggage case 100 200 can further include a primary handle 192, which can be a retractable handle 192, which for example can be attached to the fifth lateral section structure 125. As shown in FIG. 7, the retractable handle 192 can be attached to the top center component 780.

In another further related embodiment, as shown in FIGS. 1, 2, and 6, the adaptable luggage case 100 200 can further include secondary carry handles 194 196, which for example can be attached to the fourth lateral section structure 124, as respectively a horizontal carry handle 194 and a vertical carry handle 196. As shown in FIG. 6, the horizontal carry handle 194 can be attached to the top middle center component 645 and the vertical carry handle 196 can be attached to the right center side component 641.

In an embodiment, a method for assembling the adaptable luggage case 100 can include:

a) Assembling the first case side 110, including:

i. Connecting all the components of the front structure 111, thereby creating an assembled front structure 111;

ii. Successively connecting each component of the second lateral section structure 112 to the assembled front structure 111; and iii. Successively connecting each component of the third lateral section structure 113 to the assembled second lateral section structure 112;

b) Assembling the second case side 120, including:

i. Connecting all the components of the rear structure 125, thereby creating an assembled rear structure 125; and ii. Successively connecting each component of the fourth lateral section structure 124 to the assembled rear structure 125; and c) Connecting the assembled first and second case sides 110 120 with hinges 1382.

In various embodiment, different component fasteners/connectors can be used to connect components of the adaptable luggage case 100 200.

Figure 8:
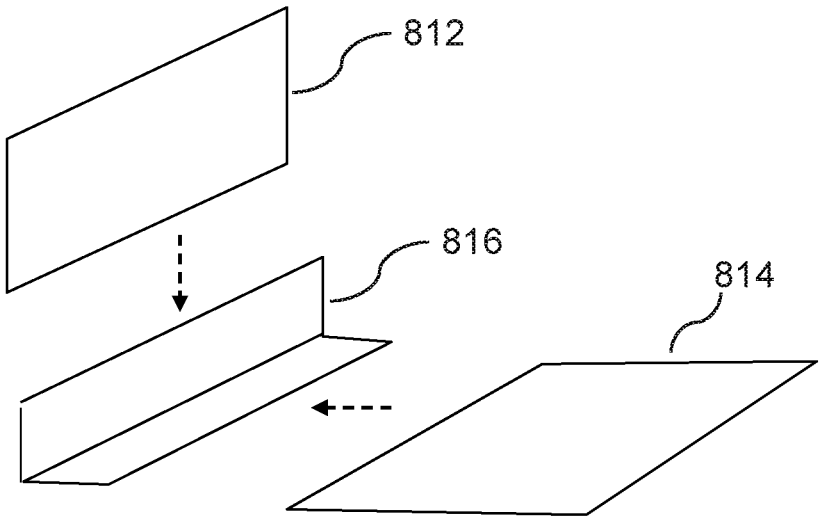
FIG. 8 is a perspective view of a component connector for an adaptable luggage case, according to an embodiment of the invention.

In a further related embodiment, FIG. 8 shows a component connector 816, configured to detachably connect a first component 812 with a second component 814, such that the component connector 816 is used to connect the first and second components 812 814.

Figure 9:
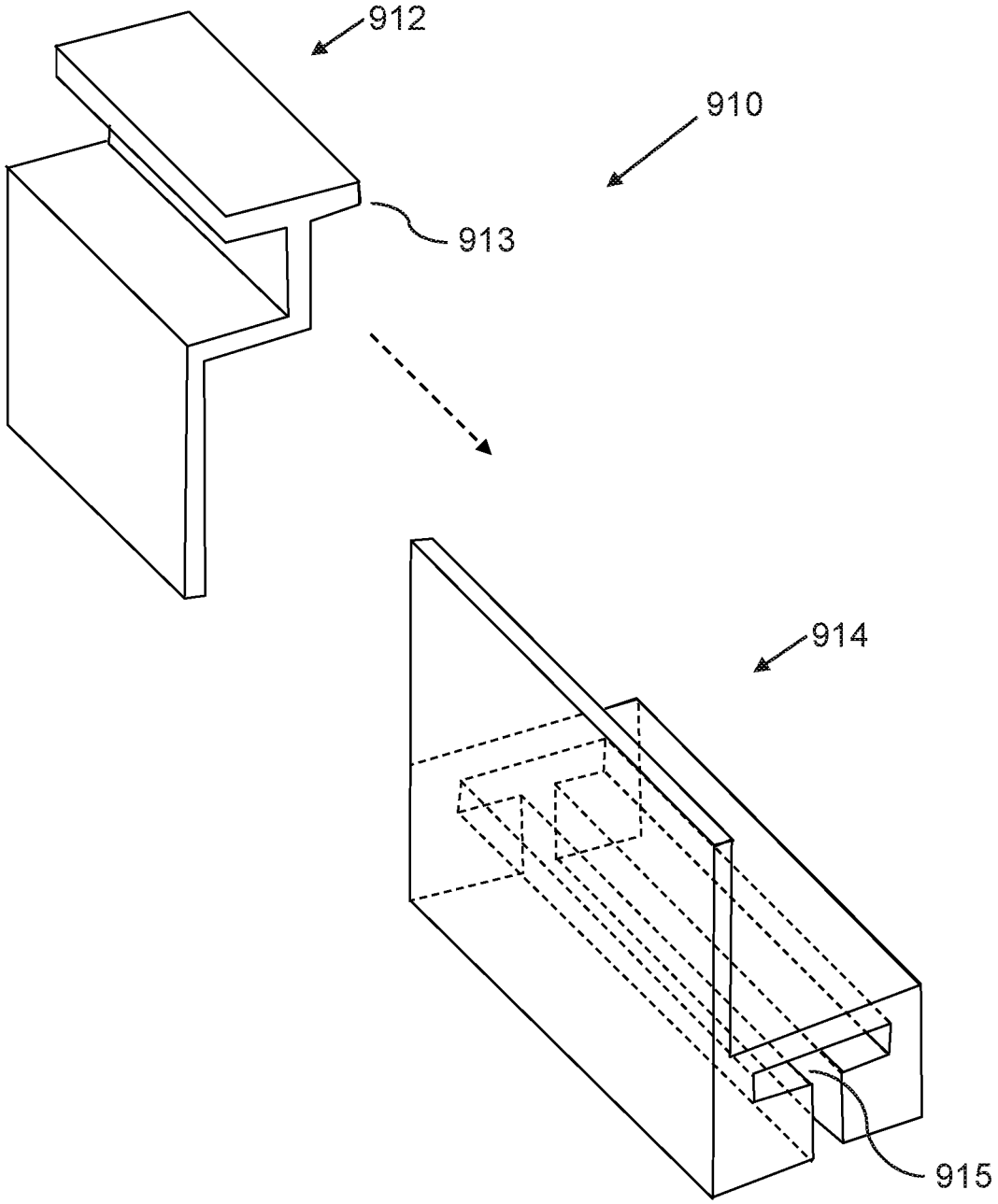
FIG. 9 is a perspective view of a component connector for an adaptable luggage case, according to an embodiment of the invention.

In yet a further related embodiment, FIG. 9 shows a component connector 910, configured to detachably connect a first component 912 with a second component 914, such that the component connector 910 is built in/molded into edges of the first and second components 912 914. As shown, the component connector 910 can be configured as a t-shaped inserter/male edge 913 of the first component 912 that is configured to slide into a t-shaped receptor/female channel/aperture 915 of the second component 914.

Figure 10:
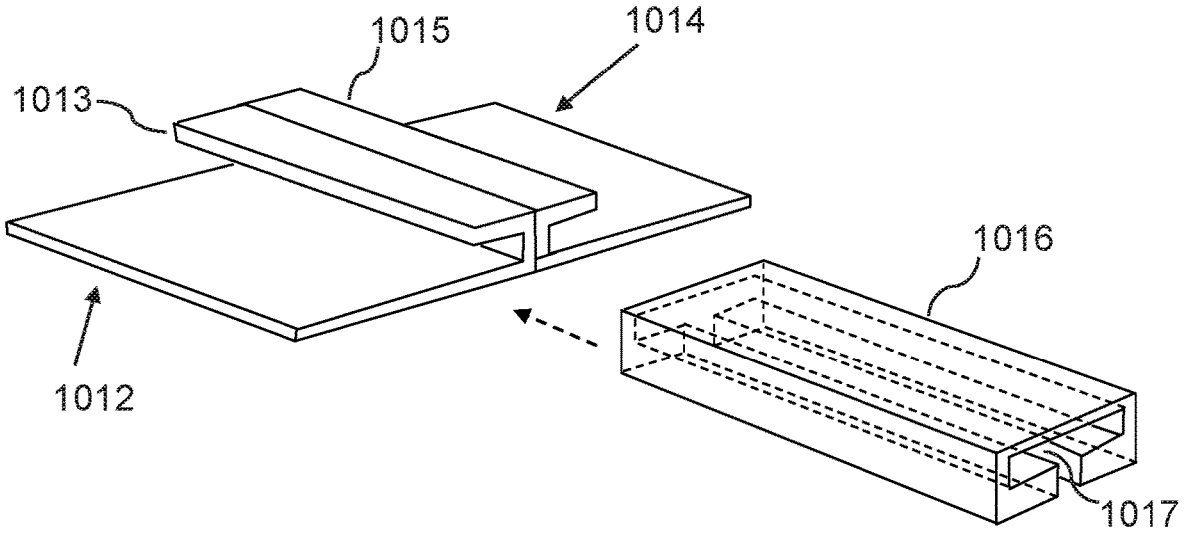
FIG. 10 is a perspective view of a component connector for an adaptable luggage case, according to an embodiment of the invention.

In another further related embodiment, FIG. 10 shows a component connector 1016 configured to detachably connect a first component 1012 with a second component 1014, such that the component connector 1016 is used to connect the first and second components 1012 1014. As shown, the first and second components 1012 can each be configured with flanges 1013 1015, which can be L-shaped, such that when the first and second components 1012 1014 are adjacently positioned the flanges 1013 1015 form a t-shaped inserter/male protrusion of the first and second components 1012 1014, such that a t-shaped receptor/female channel/aperture 1017 of the component connector 1016 is configured to slide over the t-shaped protrusion, and thereby lock the first and second components 1012 1014 together.

Figure 11:
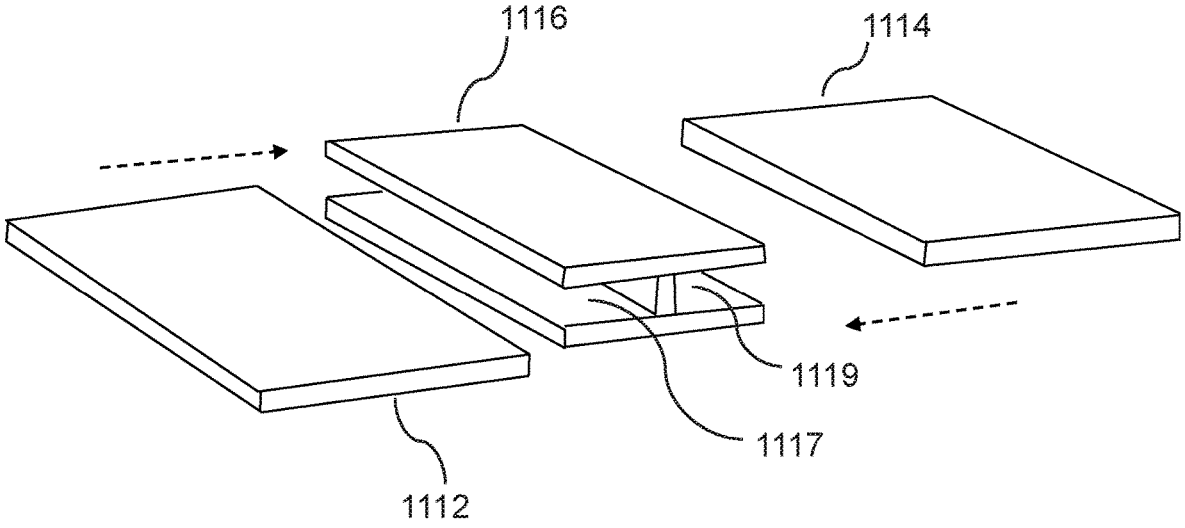
FIG. 11 is a perspective view of an assembly component for an adaptable luggage case, according to an embodiment of the invention.

In yet another further related embodiment, FIG. 11 shows a component connector 1116 configured to detachably connect a first component 1112 with a second component 1114, such that the component connector 1116 is used to connect the first and second components 812 814. As shown, the component connector 1116 can be configured with first and second insertion channels 1117 1119, such that the first and second components 1112 1114 can be configured to slide into respectively the first and second insertion channels 1117 1119, such that the component connector 1116 thereby locks the first and second components 1112 1114 together.

Figure 16:
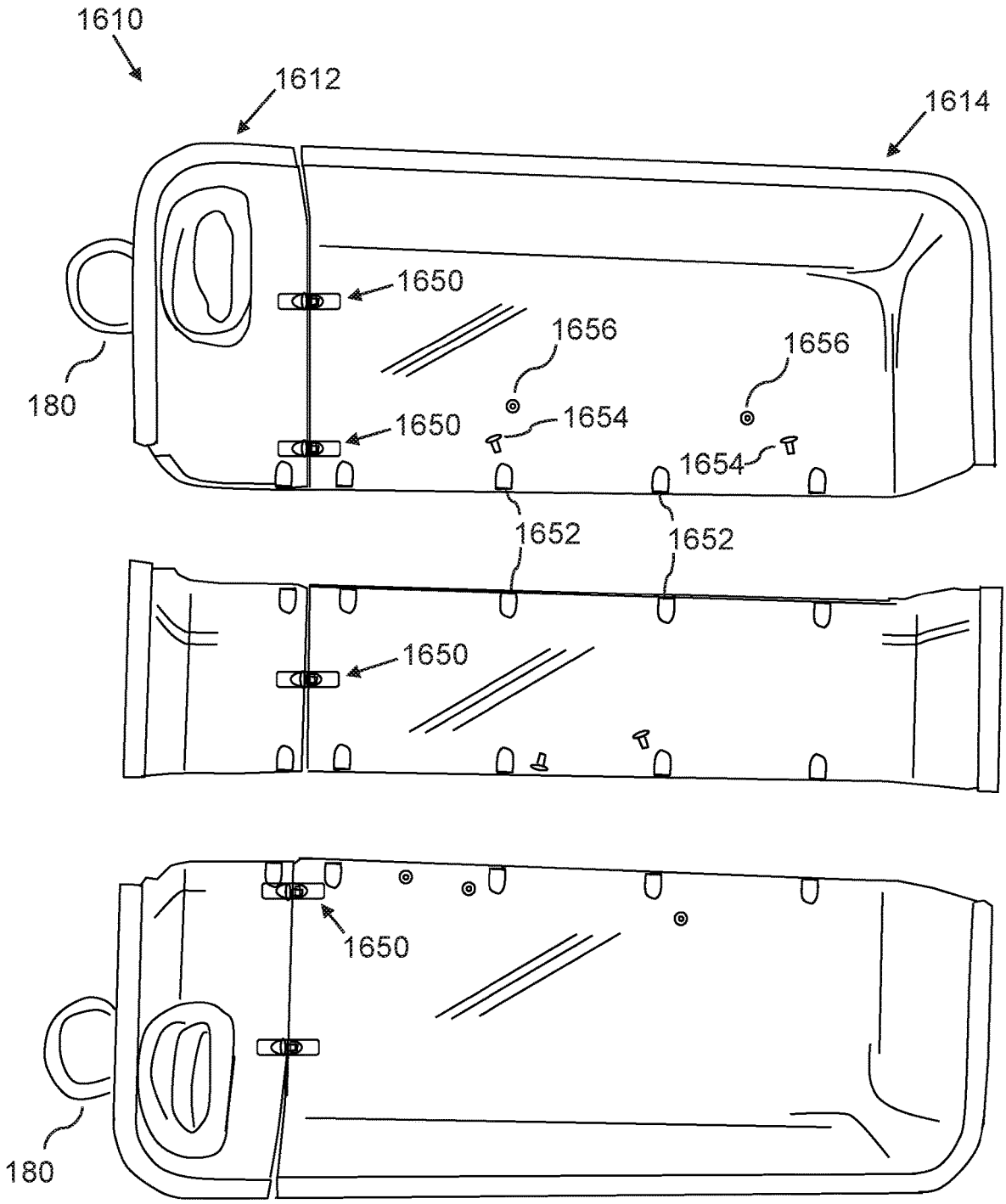
FIG. 16 is a perspective inside view of a front part of an adaptable luggage case, according to an embodiment of the invention.

In related embodiments, components can be detachably connected using various conventional connectors/fasteners, such as snap-in/snap lock connector, buttons, bolt and nut connectors 1654 1656, as shown in FIG. 16, hook and loop fastener, etc.

In a further related embodiment, as shown in FIG. 16, components 1612 1614 can be detachably connected, using a component connector 1650, comprising brackets 1652 mounted to edges of the components, such that the brackets 1652 are detachably connected using a bolt 1654 and a nut 1656, whereby the components are detachably connected. Alternatively, the components 1612 1614 can be detachably connected using a screw 1656, which is screwed through the brackets 1652.

Thus, in embodiments as disclosed herein, different types and design of component connectors 1650 can be used to detachably connect components 1612 1614. Of course, other types and designs of component connectors 1650 can be used, drawn from conventional connectors/fasteners 1650 that are well-known for use in detachable connection of components 1612 1614; and any such conventional component connectors 1650, or alternative newly developed component connectors 1650, shall be considered to be within the scope of the various embodiments of the invention.

Figure 13A:
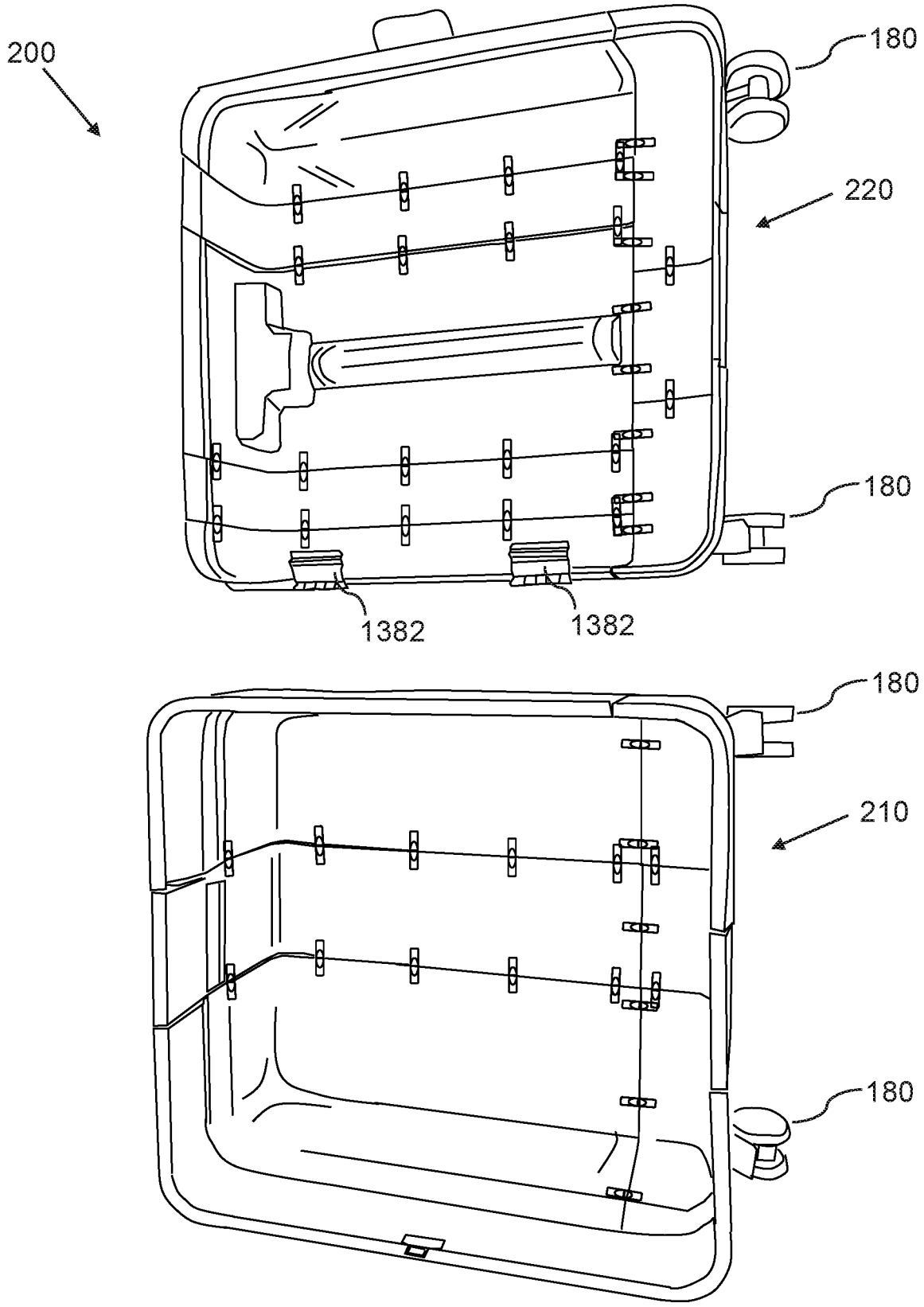
FIG. 13A is a perspective view of separated case sides of an adaptable luggage case, according to an embodiment of the invention.
Figure 13B:
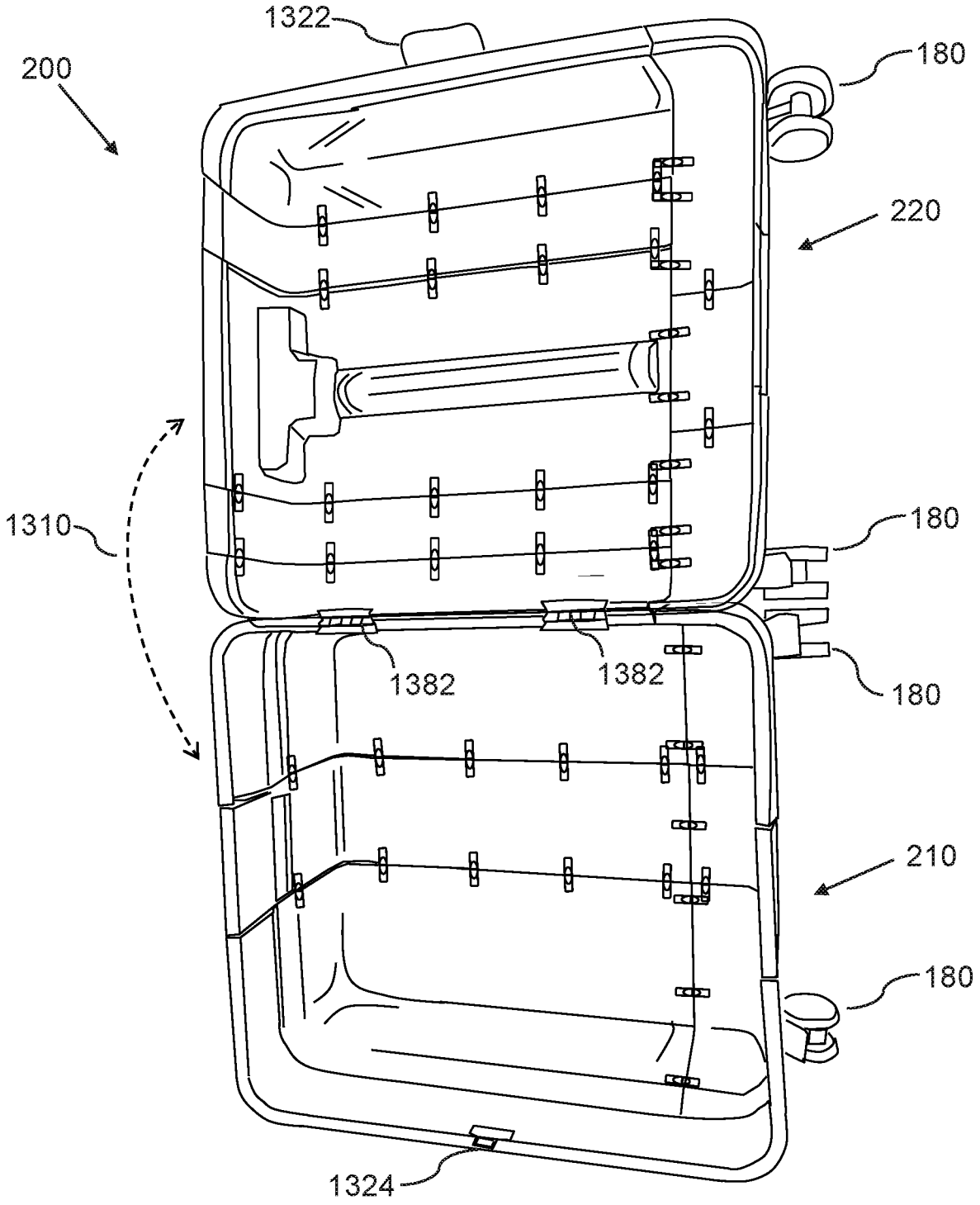
FIG. 13B is a perspective view of an adaptable luggage case in an open configuration, with pivotably connected case sides, according to an embodiment of the invention.

In another related embodiment, each of the third lateral section structure 113 and the fourth lateral section structure 124 can further include hinge connectors 580, also referred to as z spots 580, to which hinges 1382 (as shown in FIGS. 13A and 13B) can be detachable attached/connected to in order to pivotably connect the first case side 110 and the second case side 120, in order to allow opening 1310 and closing 1310 of the adaptable luggage case 100 200, as shown in FIG. 13B. The hinges 1382 can be configured as z-hinges, or other types of hinges, including various conventional hinges used for connecting sides of suitcases. Thus, the adaptable luggage case 100 can further comprise first and second hinges 1382, such that the first and second case sides 110 120 are pivotably connected with the first and second hinges 1382.

In related embodiments, as shown in FIG. 1, the adaptable luggage case 100 can be described by size properties, including: a length 102; a width 104; and a height 106 of the adaptable luggage case 100.

In a related embodiment, as shown in FIGS. 3, 4, 5, 6, and 7, a width reduction group of components, which can also be called a first group of components, can include:

a) components 304, 309, 308 (from FIG. 3);
b) components 424, 428 (from FIG. 4);
c) components 556, 558, 564, 566 (from FIG. 5);
d) components 636, 638, 644, 646 (from FIG. 6); and
e) components 774, 775, 779, 781 (from FIG. 7);

such that removal of the width reduction group of components reduces the width 104 of the adaptable luggage case 100; or more specifically such that disassembly of the components of the adaptable luggage case 100, into a complete plurality of components, removal of the width reduction group of components, and subsequent assembly of a plurality of remaining components after removal, forms a width reduced adaptable luggage case, with a reduced width 104, compared to the adaptable luggage case 100.

In a related embodiment, as shown in FIGS. 3, 4, 5, 6, and 7, a length reduction group of components, which can also be called a second group of components can include:

a) components 302, 309, 306 (from FIG. 3);
b) components 422, 426 (from FIG. 4);
c) components 553, 560, 562 (from FIG. 5);
d) components 633, 640, 642 (from FIG. 6); and
e) components 772, 775, 777 (from FIG. 7);

such that removal of the second group of components reduces the length 102 of the adaptable luggage case 100; or more specifically such that disassembly of the components of the adaptable luggage case 100, into a complete plurality of components, removal of the second group of components, and subsequent assembly of a plurality of remaining components after removal, forms a length reduced adaptable luggage case, with a reduced length 102, compared to the adaptable luggage case 100.

In a related embodiment, removal of the second lateral section structure 112, which can also be referred to as the height reduction group 112 of components or the third group 112, can decrease the height 106 of the adaptable luggage case 100, or more specifically disassembly of the components of the adaptable luggage case 100, into a complete plurality of components, removal of all components of the height reduction group 112, and subsequent assembly of a plurality of remaining components after removal, forms a height reduced adaptable luggage case, with a reduced height 106, compared to the adaptable luggage case 100.

Thus, in related embodiments, the capacity of the adaptable luggage case 100 can be adjusted by changing at least one of the length 102, the width 104 or the height 106; or by changing any two of those dimensions; or changing all three dimensions; by removal of one or more of the corresponding width, length, or height reduction groups. As would be expected, and can be seen in FIGS. 3, 4, 5, 6, and 7 there will be an overlap of shared components between the width, length, or height reduction groups, which are components at crossing/meeting points of the width, length, or height reduction groups.

In an embodiment, all components of an adaptable luggage case 100 can include solely one width reduction group, one length reduction group, and one height reduction group. However, in order to increase the number of changes that can apply to the capacity of an adaptable luggage case, the adaptable luggage case can alternatively be configured to include more than one width reduction group, length reduction group, and/or height reduction group, respectively added to the adaptable luggage case, to form a larger adaptable luggage case, with more options for reductions of width, length, and/or height.

In a related embodiment, FIG. 1 shows a maximum capacity configuration of the adaptable luggage case 100, and FIG. 2 shows a minimum capacity configuration of the adaptable luggage case 100, after removing the width, length, or height reduction groups.

Figure 12:
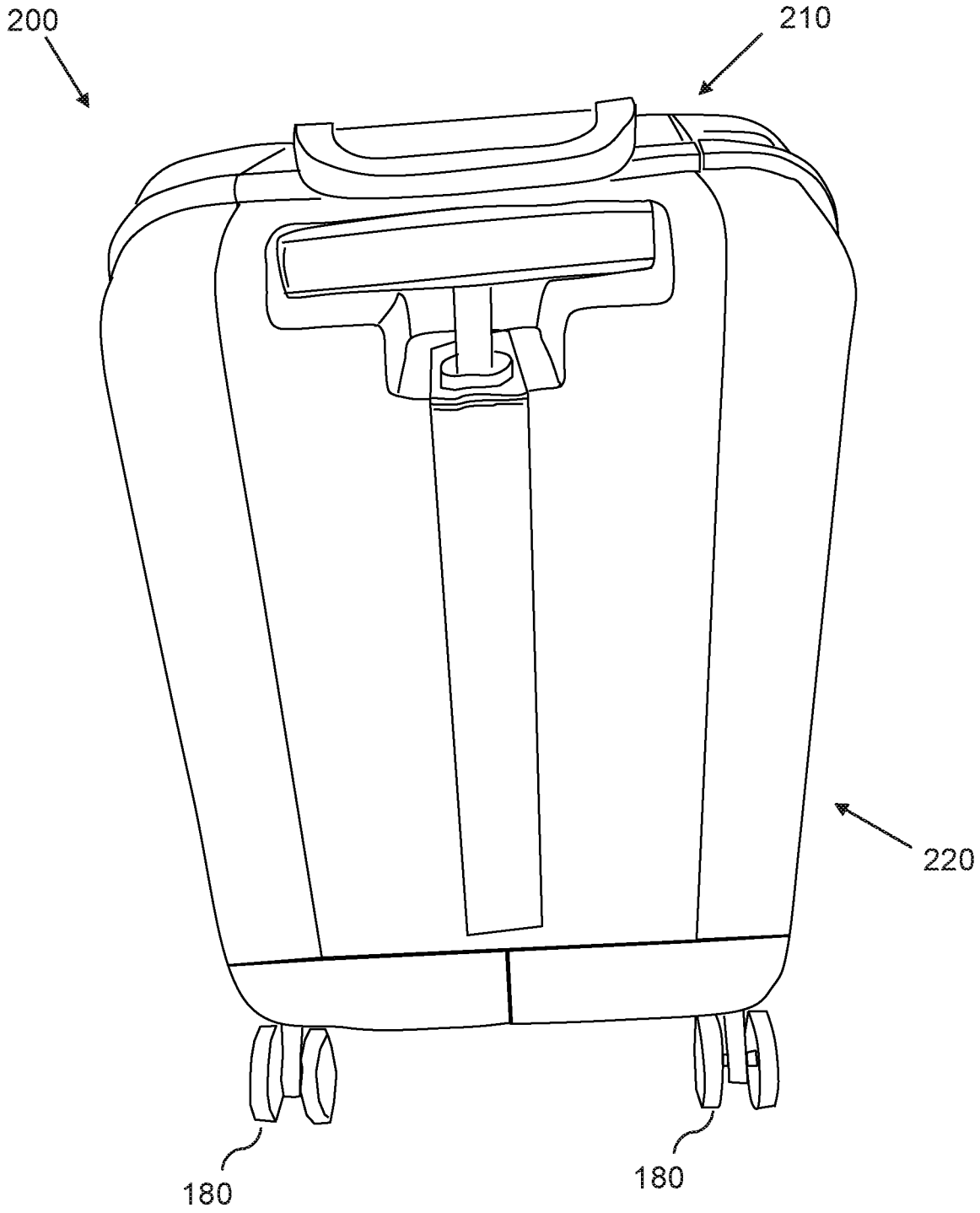
FIG. 12 is a rear perspective view of an adaptable luggage case, according to an embodiment of the invention.

In a related example embodiment, FIG. 12 shows a rear view of the adaptable luggage case 200, showing mainly the second case side 220, which can also be called the rear side 220.

In a related example embodiment, FIG. 13A shows the adaptable luggage case 200, separated into the first and second case sides 210 220. As shown, an outer end of the hinges has been detached from its detachable connection 580 to an inner side of the first/front case side 210, as shown in FIG. 5.

In a related example embodiment, FIG. 13B shows the adaptable luggage case 200, in an open configuration, with the first and second case sides 210 220 pivotably connected with the hinges 1382. The adaptable luggage case 200 can be closed by pivoting/swinging 1310 one or both of the first and second case sides 210 220 via a rotation/pivoting around a pivotal axis of the hinges 1382. The adaptable luggage case 100 200 can further include clasps 1322 and clasp connectors 1324 for securing the adaptable luggage case 100 200 in a closed configuration once closed.

Figure 14:
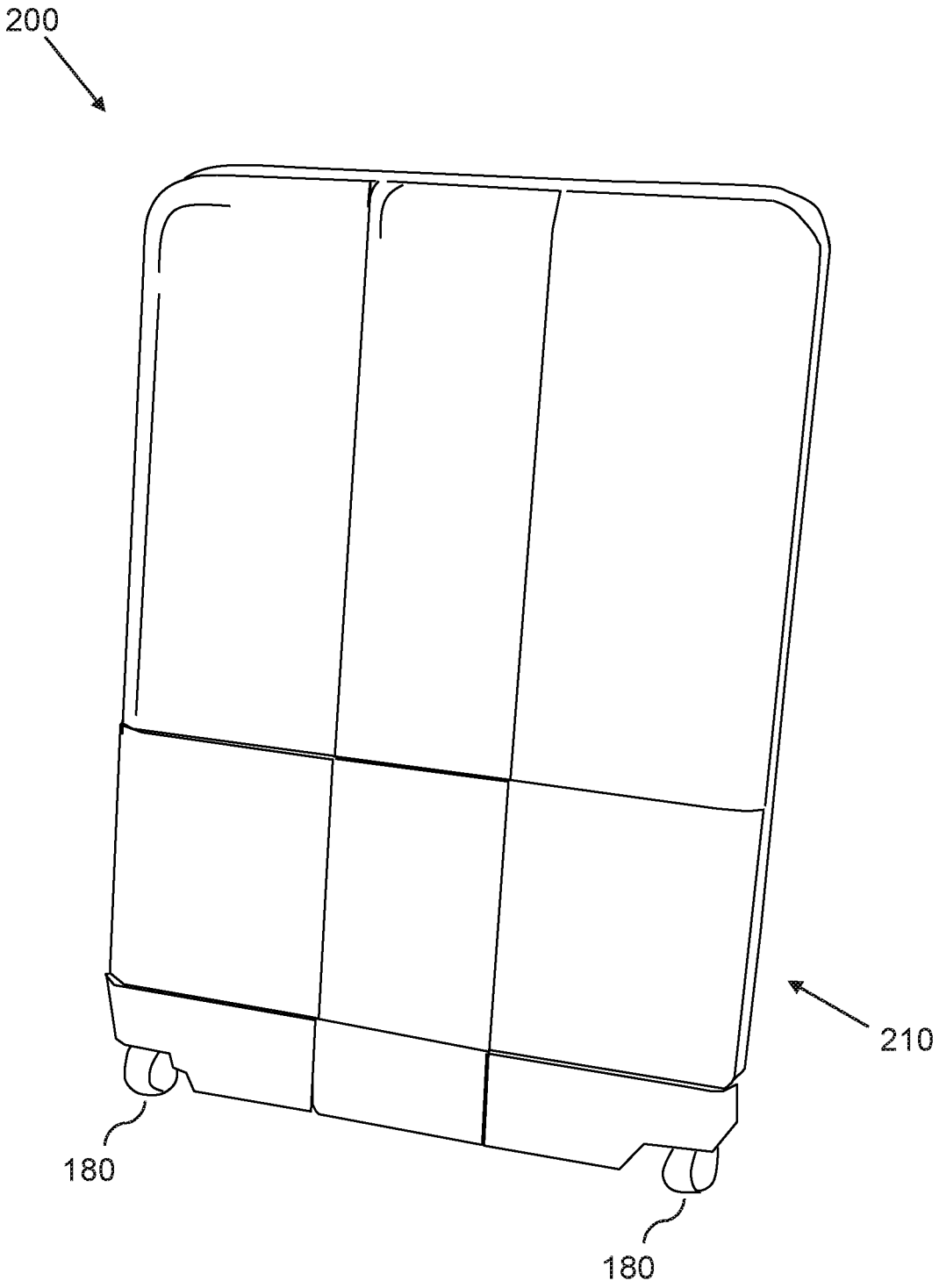
FIG. 14 is a front perspective view of an adaptable luggage case, according to an embodiment of the invention.

In a related example embodiment, FIG. 14 shows a front view of the adaptable luggage case 200, showing mainly the first case side 210, which can also be called the front side 210.

Figure 15:
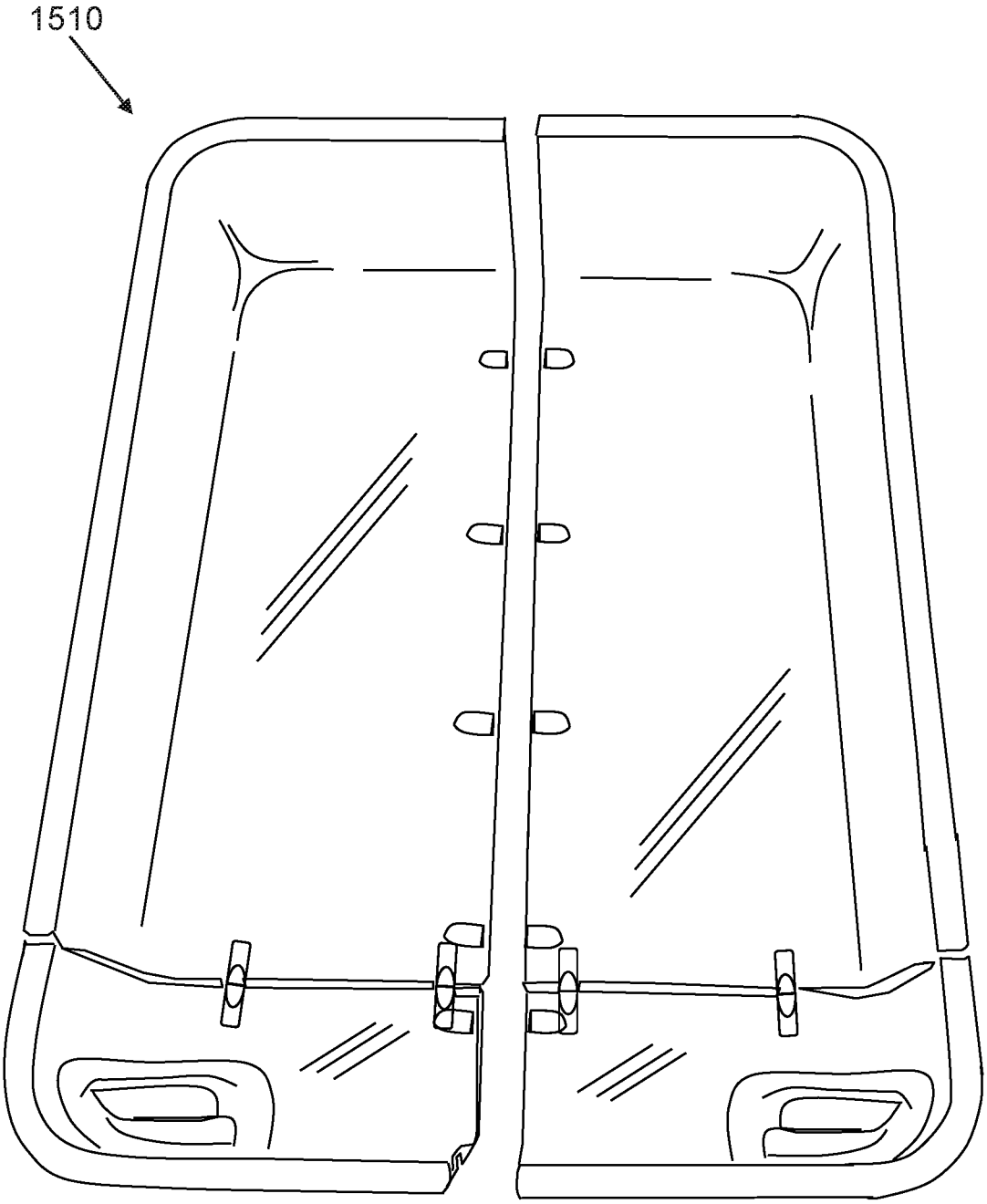
FIG. 15 is a perspective inside view of a front part of an adaptable luggage case, according to an embodiment of the invention.

In a related example embodiment, FIG. 15 shows an inside view of partially assembled components of a first case side 1510 of an adaptable luggage case in a minimal configuration.

In a related example embodiment, FIG. 16 shows an inside view of partially assembled components of a first case side 1610 of an adaptable luggage case in a minimal configuration.

Here has thus been described a multitude of embodiments of the adaptable luggage case 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

For example, the measurements and proportions of the components shown in the drawings are merely illustrative examples, and other measurements and proportions should be considered fully included herein.

Many such alternative configurations are readily apparent, and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. An adaptable luggage case, comprising:

a) a first case side, comprising:

at least one lateral section structure, comprising a first case side plurality of detachably connected components; and b) a second case side, comprising:

at least one lateral section structure, comprising a second case side plurality of detachably connected components;

wherein in the first and second case sides are pivotably connected, such that a single interior is formed between the first case side and the second case side, when the adaptable luggage case is closed;

wherein the adaptable luggage case is configured to be disassembled into a complete plurality of components, which comprises a reduction group of components and a reduced plurality of components;

such that the reduced plurality of components is configured to be assembled into a reduced size luggage case, which is smaller than the adaptable luggage case;

wherein the complete plurality of components comprises a width reduction group of components, which is configured such that disassembly of the adaptable luggage case, into the complete plurality of components, a first removal of the width reduction group of components, and subsequent assembly of a plurality of first remaining components after the first removal, forms a width reduced luggage case with a reduced width, compared to the adaptable luggage case; and wherein the complete plurality of components comprises a length reduction group of components, which is configured such that disassembly of the adaptable luggage case, into the complete plurality of components, a second removal of the length reduction group of components, and subsequent assembly of a plurality of remaining components after the second removal, forms a length reduced luggage case with a reduced length, compared to the adaptable luggage case;

wherein the first case side, comprises:

a first lateral section structure, comprising a first lateral section plurality of detachably connected components;

a second lateral section structure, comprising a second lateral section plurality of detachably connected components, such that the second lateral section structure is detachably connected to the first lateral section structure; and a third lateral section structure, comprising a third lateral section plurality of detachably connected components, such that the third lateral section structure is detachably connected to the second lateral section structure; and wherein the second case side, comprising:

a fourth lateral section structure, comprising a fourth lateral section plurality of detachably connected components; and a fifth lateral section structure, comprising a fifth lateral section plurality of detachably connected components, such that the fifth lateral section structure is detachably connected to the fourth lateral section structure;

wherein the first lateral section structure forms a front of the adaptable luggage case;

wherein the fifth lateral section structure forms a rear of the adaptable luggage case;

such that the first, second, third, fourth, and fifth lateral section pluralities of detachably connected components comprise the complete plurality of components.

2. The adaptable luggage case of claim 1, further comprising first and second hinges, such that the first and second case sides are pivotably connected with the first and second hinges.

3. The adaptable luggage case of claim 1, further comprising at least two wheels connected to a bottom of the adaptable luggage case, such that the adaptable luggage case is an adaptable trolley case.

4. The adaptable luggage case of claim 1, wherein each component of the first and fifth lateral section structures comprises a flat part and a flange part that is perpendicularly connected to the flat part, such that each of the first and fifth lateral section structures is pan-shaped.

5. The adaptable luggage case of claim 1, wherein each of the second, third, and fourth lateral section structures is configured as a rectangular edge band that forms a siding part of the adaptable luggage case.

6. The adaptable luggage case of claim 1, further comprising a component connector, wherein a first component and a second component in the complete plurality of components are detachably connected with the component connector.

7. The adaptable luggage case of claim 6, wherein the first component and the second component are each configured with flanges, and wherein the component connector is configured with a t-shaped receptor channel, such that when the first and second components are adjacently positioned the flanges form a t-shaped male protrusion of the first and second components, such that the t-shaped receptor is configured to slide over the t-shaped protrusion, and thereby lock the first and second components together.

8. The adaptable luggage case of claim 1, wherein the complete plurality of components comprises a height reduction group of components, which is configured such that disassembly of the adaptable luggage case, into the complete plurality of components, removal of the height reduction group of components, and subsequent assembly of a plurality of remaining components after the removal, forms a height reduced luggage case with a reduced height, compared to the adaptable luggage case.

9. An adaptable luggage case, comprising a complete plurality of components that are detachably connected;

such that the adaptable luggage case comprises a single interior, when the adaptable luggage case is closed;

wherein the adaptable luggage case, comprises:

a) a first case side, comprising:

a first lateral section structure, comprising a first lateral section plurality of detachably connected components;

a second lateral section structure, comprising a second lateral section plurality of detachably connected components, such that the second lateral section structure is detachably connected to the first lateral section structure; and a third lateral section structure, comprising a third lateral section plurality of detachably connected components, such that the third lateral section structure is detachably connected to the second lateral section structure; and b) a second case side, comprising:

a fourth lateral section structure, comprising a fourth lateral section plurality of detachably connected components; and a fifth lateral section structure, comprising a fifth lateral section plurality of detachably connected components, such that the fifth lateral section structure is detachably connected to the fourth lateral section structure;

wherein the first lateral section structure forms a front of the adaptable luggage case;

wherein the fifth lateral section structure forms a rear of the adaptable luggage case;

such that the first, second, third, fourth, and fifth lateral section pluralities of detachably connected components comprise the complete plurality of components;

wherein the adaptable luggage case is configured to be disassembled into the complete plurality of components, which comprises a first reduction group of components and a first reduced plurality of components;

such that the first reduced plurality of components is configured to be assembled into a first reduced size luggage case, which is smaller than the adaptable luggage case;

wherein the complete plurality of components comprises a width reduction group of components, which is configured such that disassembly of the adaptable luggage case, into the complete plurality of components, removal of the width reduction group of components, and subsequent assembly of a plurality of remaining components after the removal, forms a width reduced luggage case with a reduced width, compared to the adaptable luggage case; and wherein the complete plurality of components comprises a height reduction group of components, which is configured such that disassembly of the adaptable luggage case, into the complete plurality of components, removal of the height reduction group of components, and subsequent assembly of a plurality of remaining components after the removal, forms a height reduced luggage case with a reduced height, compared to the adaptable luggage case.

10. The adaptable luggage case of claim 9, wherein the first reduced plurality of components comprises a second reduction group of components and a second reduced plurality of components;

such that the second reduced plurality of components is configured to be assembled into a second reduced size luggage case, which is smaller than the first reduced size luggage case.

11. The adaptable luggage case of claim 9, further comprising first and second case sides, and first and second hinges; such that the first and second case sides are pivotably connected with the first and second hinges.

12. The adaptable luggage case of claim 9, further comprising a component connector, wherein a first component and a second component in the complete plurality of components are detachably connected with the component connector;

wherein the first component and the second component are each configured with flanges, and wherein the component connector is configured with a t-shaped receptor channel, such that when the first and second components are adjacently positioned the flanges form a t-shaped male protrusion of the first and second components, such that the t-shaped receptor is configured to slide over the t-shaped protrusion, and thereby lock the first and second components together.

13. The adaptable luggage case of claim 9, wherein the complete plurality of components comprises a length reduction group of components, which is configured such that disassembly of the adaptable luggage case, into the complete plurality of components, removal of the length reduction group of components, and subsequent assembly of a plurality of remaining components after the removal, forms a length reduced luggage case with a reduced length, compared to the adaptable luggage case.

14. An adaptable luggage case system, comprising a complete plurality of components, which are configured to be detachably connected into an adaptable luggage case, such that the adaptable luggage case comprises a single interior, when the adaptable luggage case is closed;

wherein the complete plurality of components comprises a first reduction group of components and a first reduced plurality of components;

such that the first reduced plurality of components is configured to be assembled into a first reduced size luggage case, which is smaller than the adaptable luggage case;

wherein the complete plurality of components comprises a length reduction group of components, which is configured such that disassembly of the adaptable luggage case, into the complete plurality of components, removal of the length reduction group of components, and subsequent assembly of a plurality of remaining components after the removal, forms a length reduced luggage case with a reduced length, compared to the adaptable luggage case; and wherein the complete plurality of components comprises a height reduction group of components, which is configured such that disassembly of the adaptable luggage case, into the complete plurality of components, removal of the height reduction group of components, and subsequent assembly of a plurality of remaining components after the removal, forms a height reduced luggage case with a reduced height, compared to the adaptable luggage case;

wherein the adaptable luggage case, comprises:

a) a first case side, comprising:

a first lateral section structure, comprising a first lateral section plurality of detachably connected components;

a second lateral section structure, comprising a second lateral section plurality of detachably connected components, such that the second lateral section structure is detachably connected to the first lateral section structure; and a third lateral section structure, comprising a third lateral section plurality of detachably connected components, such that the third lateral section structure is detachably connected to the second lateral section structure; and b) a second case side, comprising:

a fourth lateral section structure, comprising a fourth lateral section plurality of detachably connected components; and a fifth lateral section structure, comprising a fifth lateral section plurality of detachably connected components, such that the fifth lateral section structure is detachably connected to the fourth lateral section structure;

wherein the first lateral section structure forms a front of the adaptable luggage case;

wherein the fifth lateral section structure forms a rear of the adaptable luggage case;

such that the first, second, third, fourth, and fifth lateral section pluralities of detachably connected components comprise the complete plurality of components.

15. The adaptable luggage system of claim 14, wherein the first reduced plurality of components comprises a second reduction group of components and a second reduced plurality of components;

such that the second reduced plurality of components is configured to be assembled into a second reduced size luggage case, which is smaller than the first reduced size luggage case.

* * * * *